US006725913B2

(12) United States Patent
Memory et al.

(10) Patent No.: US 6,725,913 B2
(45) Date of Patent: Apr. 27, 2004

(54) HIGH PRESSURE HEADER AND HEAT EXCHANGER AND METHOD OF MAKING THE SAME

(75) Inventors: Stephen Memory, Kenosha, WI (US); Gregory G. Hughes, Milwaukee, WI (US); C. James Rogers, Racine, WI (US)

(73) Assignee: Modine Manufacturing Company, Racine, WI (US)

( * ) Notice: Subject to any disclaimer, the term of this patent is extended or adjusted under 35 U.S.C. 154(b) by 232 days.

(21) Appl. No.: 10/012,865

(22) Filed: Nov. 30, 2001

(65) Prior Publication Data

US 2003/0102116 A1 Jun. 5, 2003

(51) Int. Cl.[7] ..... F28D 1/02; F28F 9/02; F28F 9/04

(52) U.S. Cl. ..... 165/173; 165/175; 165/178; 165/153; 29/890.053

(58) Field of Search ..... 165/173, 175, 165/176, 178, 153, 79, 67; 29/890.053, 890.043

(56) References Cited

U.S. PATENT DOCUMENTS 3,497,936 A 3/1970 Donaldson
3,797,568 A * 3/1974 Kormann ..... 165/131
4,292,958 A 10/1981 Lee
4,678,112 A 7/1987 Koisuka et al.
4,709,689 A * 12/1987 Simcox ..... 126/665
5,062,476 A * 11/1991 Ryan et al. ..... 165/173
5,082,051 A 1/1992 Ando
5,099,576 A 3/1992 Shinmura
5,214,847 A 6/1993 Aoki
5,320,165 A * 6/1994 Hughes ..... 165/153
5,487,422 A * 1/1996 Bertva et al. ..... 165/67
6,170,569 B1 * 1/2001 Dienhart et al. ..... 165/173
6,223,812 B1 * 5/2001 Gough ..... 165/173

* cited by examiner

*Primary Examiner*—Henry Bennett
*Assistant Examiner*—Tho V Duong
(74) *Attorney, Agent, or Firm*—Wood, Phillips, Katz, Clark & Mortimer

(57) ABSTRACT

A method of providing volume production of highly pressure resistant headers (10), (12) is provided and allows the headers (10), (12) to be formed of a header structure (10), (12) with a relatively thin wall portion (32) and a relatively thick wall portion (30). A strip (40) is utilized to provide the desired thickness at the thin wall portion (32) while allowing both the thin wall portion (32) and the strip (40) to have tube slots (34), (42) formed therein by a one step punching operation.

20 Claims, 2 Drawing Sheets

HIGH PRESSURE HEADER AND HEAT EXCHANGER AND METHOD OF MAKING THE SAME

FIELD OF THE INVENTION

This invention relates to headers for heat exchangers, and more particularly, to headers and heat exchangers incorporating such headers which are designed for extremely high pressure applications.

BACKGROUND OF THE INVENTION

Concern for global warming and the deterioration of the ozone layer as a result of the escape of fluorine containing refrigerants from refrigeration systems, including air conditioning systems, has prompted a new look at refrigeration systems utilizing more environmentally friendly refrigerants. One such system under study is a carbon dioxide ($CO_2$) based system wherein $CO_2$ is employed as the refrigerant. $CO_2$ systems operate at significantly higher internal pressure than do conventional systems employing fluorine based refrigerants and as a consequence, there is a need to improve the pressure resistance of heat exchangers used in such applications as, for example, the gas cooler and the evaporator of such systems.

At the same time, these systems have the potential for extensive use in vehicular air conditioning systems where weight, because of its impact on fuel economy, is of considerable concern. This consideration makes it impossible to achieve the desired pressure resistance simply by expanding wall thickness of conventional heat exchangers used in such systems without other major changes because of the added weight of thicker walled elements. Furthermore, this solution is not an economically viable one because taking existing components without changing their size other than to increase wall thickness to achieve pressure resistance means more material will have to go into the heat exchanger, most notably in the headers, thereby increasing the cost of the resulting heat exchanger.

Various solutions to this problem have been proposed. For example, many of the heat exchangers employ tubular headers which are generally cylindrical in shape. Conventional flattened tubes have their ends fitted in tube slots in the headers, which tube slots are transverse to the direction of elongation of the header. It has been proposed to reduce the diameter of the header and reorient the tube slots so that they are elongated in the direction of elongation of the header. The tubes are then provided with a twist near where their ends enter the header so as to present a desired orientation of the tubes for air flow between the tubes through the heat exchanger.

One primary difficulty in this approach is that with smaller diameter headers, the process of forming the tube slots in the headers has become increasingly difficult. In order to have a desired wall thickness in the smaller diameter headers, it has been necessary to form the tube slots by machining procedures as, for example, by milling. Unfortunately, these machining operations are time consuming and expensive and are particularly more costly than the various punching techniques that have been used to form transverse tube slots in cylindrical headers in conventional heat exchangers utilizing conventional refrigerants.

Thus, there is a real need for a less costly header for use in high pressure heat exchangers, such as those used as condensers, gas coolers and/or evaporators in high pressure refrigeration systems. The present invention is directed to meeting that need.

SUMMARY OF THE INVENTION

It is the principal object of the invention to provide a) a new and improved method for making a header for a high pressure heat exchanger, b) a new and improved header with high pressure resistance for use in high pressure heat exchangers, and c) a new and improved heat exchanger having improved pressure resistance enabling it to function in a high pressure system as, for example, a high pressure refrigeration system such as a $CO_2$ refrigeration system.

According to one facet of the invention, there is provided a method of making a high pressure resistant header for a heat exchanger which includes the steps of a) providing an elongated header structure including a central cylindrical passage surrounded by a wall of sufficient thickness to resist deformation when a fluid is placed within the passage at an operating pressure at which deformation is to be resisted, b) thinning the wall along its length by providing a first mating surface on a part thereof so that the wall, at the first mating surface is sufficiently thin that tube slots may be formed therein by punching as opposed to more expensive machining procedures, c) punching tube slots at predetermined spaced intervals of the wall at the first mating surface, d) providing an elongated strip having a second mating surface complimentary to the first mating surface and of a thickness such that the combined thickness of the strip and the wall at its first mating surface is about equal to or greater than the desired thickness of the wall, e) punching tube slots in the strip at the predetermined spaced intervals which are of substantially the same size and shape as the tube slots in the first mating surface, f) abutting the second mating surface of the strip to the first mating surface of the header structure with the tube slots in each being aligned with one another and g) thereafter bonding the strip to the header structure along their respective lengths to provide a unitary header with tube slots therein.

In a preferred embodiment, both of the mating surfaces are flat surfaces.

A preferred embodiment also contemplates that steps a) and b) are performed simultaneously by extrusion of the header structure.

Preferably, the first mating surface is formed on the exterior of the header structure.

In one embodiment, step b) is performed by providing a strip receiving groove in that part of the header structure exterior surface and the groove has a flat bottom surface defining the first mating surface.

In one embodiment, the header structure has a semi-oval exterior surface with the first mating surface being located between the sides of the semi-oval.

In one embodiment, the first mating surface extends between the sides of the semi-oval.

According to another aspect of the invention, a header for a high pressure heat exchanger is provided. The header includes an elongated tubular like element having a central, generally cylindrical passage in a tube receiving side. The element is a unitary structure and has a relatively thick wall partially surrounding the passage and a relatively thin wall at the tube receiving side. A first mating surface defined by a relief is located at the relatively thin wall of the element and a plurality of punched first tube receiving slots are located at the first mating surface and are in fluid communication with the passage and are located at predetermined spaced intervals. An elongated strip having a second mating surface complementary to and abutted against the first mating surface is provided such that the thickness of the strip and the thin wall is substantially equal to or greater than the thickness of the thick wall. A second plurality of tube receiving slots are located in the strip and are punched therein and located at the same predetermined intervals as the tube slots in the first mating surface and are of generally the same size and shape as well. They are aligned with the first tube receiving slots. A joint is provided that bonds the element and the strip together.

Preferably, the joint is a brazed joint.

According to still another facet of the invention, a high pressure heat exchanger is provided and includes a header as described previously. The tube slots are elongated in the direction of elongation of the element forming the header and a plurality of tubes, each of flattened cross section are provided and have their ends disposed within corresponding ones of the tube slots. The ends of the tubes are twisted about 90° to the remainder of the corresponding tube and fins extend between and are bonded to adjacent ones of the remainders of the tubes.

Preferably, the fins are serpentine fins.

Other objects and advantages will become apparent from the following specification taken in connection with the accompanying drawings.

DESCRIPTION OF THE PREFERRED EMBODIMENT

Figure 1:
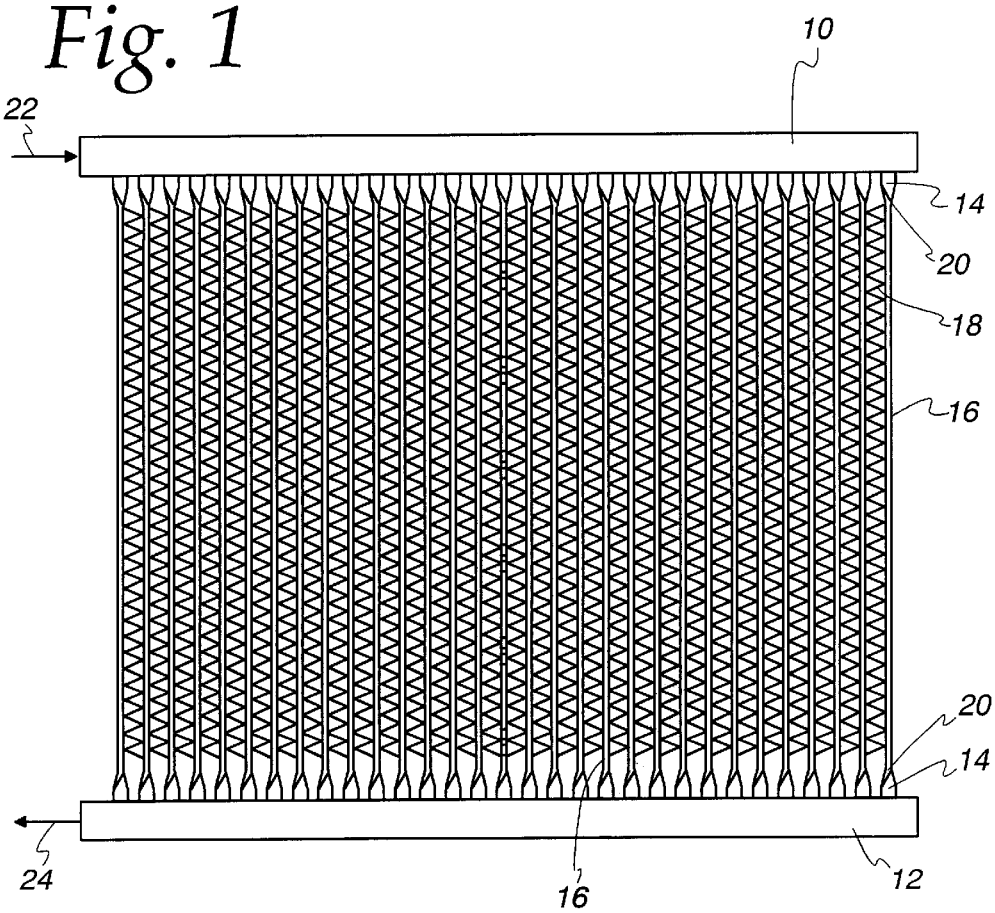
FIG. 1 is an elevational view of a heat exchanger made according to the invention.

A heat exchanger made in accordance with the invention is illustrated in FIG. 1 and will be described in the context of a refrigeration system. However, the invention, in each of its facets, is applicable to high pressure heat exchangers, generally; and no limitation to refrigeration systems is intended except as set forth in the claims. The heat exchanger is seen to include opposed, spaced headers 10 and 12. The headers 10 and 12 are tubular as will be seen hereinafter and receive the ends 14 of straight flattened tubes 16. The ends 14 are in fluid communication with the interior of the headers 10, 12 and spaced from one another. Alternatively, the headers 10, 12 could be closely adjacent to one another with U-shaped flattened tubes (not shown) placed in fluid communication with the interiors of the headers 10, 12.

Fins 18, preferably serpentine fins, extend between and are bonded to adjacent ones of the tubes 16 between the ends 14.

The tubes 16 are flattened tubes and between the ends 14, have their major dimension running from front to back of the heat exchanger. That is to say, the fins 18 are bonded to the sides of the tubes 16 along their major dimensions. The minor dimension faces forward to minimize the obstruction to air flow imposed by the tubes 16 themselves.

Adjacent to the ends 14, the tubes 16 include a twist 20 allowing the ends 14 to be inserted into tube slots (not shown in FIG. 1) that are elongated and extend in the direction of elongation of the headers 10, 12. In the usual case, the twist 20 will be 90°, although other angles could be employed if desired.

One of the headers 10 may be provided with an inlet schematically indicated by an arrow 22 while the opposite header is provided with an outlet, schematically illustrated by an arrow 24. Of course, in some instances, the heat exchanger may be a so-called multi-pass heat exchanger, in which case baffles to direct the flow back and forth between the headers 10, 12 at least once may be provided. When the number of passes is an even number, both the inlet 22 and the outlet 24 will be in the same header 10, 12 whereas, for a single pass heat exchanger, or a multiple pass heat exchanger having an odd number of passes, the inlet 22 and outlet 24 will be in different ones of the headers 10, 12. Moreover, if desired, a multiple row heat exchanger could be made using a plurality of the structures shown in FIG. 1 in stacked relation with the headers 10 and/or 12 connected by manifolds which in turn can be baffled as well to provide any desired flow circuit.

Figure 2:
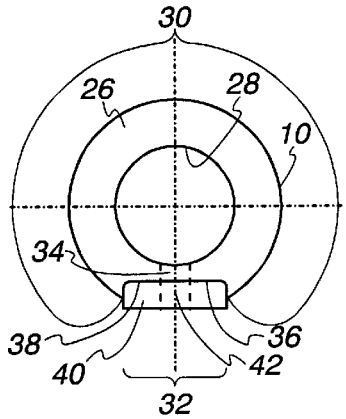
FIG. 2 is a cross-section of one embodiment of a header made according to the invention.
Figure 3:
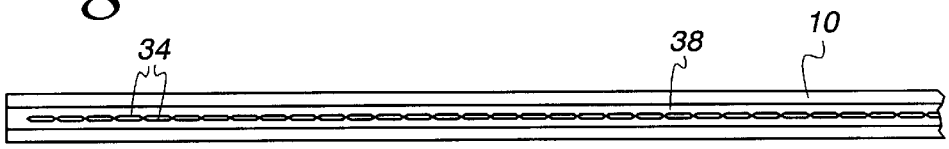
FIG. 3 is a plan view of a header made according to the invention.
Figure 4:
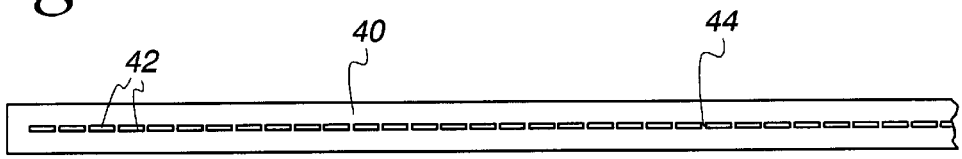
FIG. 4 is a plan view of a strip that is applied to the header element shown in FIG. 3 to form a header made according to the invention.

Turning now to FIGS. 2–4, the headers 10, 12 will be described. As both are identical to each other, only the header 10 will be described in detail, it being understood that the same description applies to the header 12.

As seen in FIG. 2, the header 10 is a cylindrical tube 26 having a central, cylindrical bore 28 which serves as a passageway for one of the heat exchange fluids used with the heat exchanger. The header 10 has a relatively thick walled portion 30 and a relatively thin walled portion 32. The thick walled portion 30 is provided with a thickness sufficient to withstand, without deformation, the typical operating pressures encountered within the passage 28 during operation of the heat exchanger within a refrigeration system, plus an appropriate safety factor. The thin walled portion 32, at its thinnest point, has a thickness about half of that of the thick walled portion 30; and this thickness is such that a series of elongated tube slots 34 may be provided in the thin walled portion by a simple punching operation. In the embodiment illustrated in FIG. 2, the thin walled portion 32 is defined by the flat bottom 36 of a relief in the form of a groove 38 formed along the length of the header 10. The bottom 36 serves as a first mating surface and typically will be flat but may take on other configurations if desired.

According to the invention, an elongated strip 40 is bonded in the groove 38 as by brazing or soldering. To this end, the strip 40 typically will be braze clad. Such bonds are generically referred to herein as metallurgical bonds. The strip 40 has a plurality of elongated tube receiving slots 42 which are of the same size and shape as the slots 34 and the header 10. They are also located at the same predetermined intervals as the slots 34. Thus, the elongated strip 40 may be inserted within the groove 38 and the tube slots 34 and 42 aligned with one another preliminary to forming the aforementioned metallurgical bond.

The strip 40 has a flat surface 44 which is a second mating surface to mate with the bottom 36 of the groove 38. When other than flat surfaces are used as the bottom of the groove 36, the surface 40 will be configured to be complementary to the shape of the bottom 36 of the groove 38.

The strip 40 has a thickness approximately equal to or greater than half the thickness of the thick walled portion 30 of the header 10, or vice versa, so that the tube slots 42 may be formed therein by a simple punching operation. When assembled as illustrated in FIG. 2, the minimum total thickness of the header 10 at its thin walled portion 32 and the strip 40 will be equal to or exceed the thickness of the thick walled portion 30 of the remainder of the header.

In the usual case, aluminum will be utilized as the material for forming both the header 10 and the strip 40 because of its light weight so as to minimize the mass of the heat exchanger in which the header is used. However, other materials could be utilized if desired.

Significantly, the thickness of the thin walled portion 32 and the strip 44 are both chosen so that the tube slots 34, 42 may be punched in the respective elements 10, 40, rather than requiring forming by machining operations such as milling. As a result, the resulting tube slots, which are a combination of the slots 34 and 42, may be inexpensively formed thereby reducing the cost of the resulting header.

In a preferred embodiment, the headers 10 are formed by extrusion although it is possible to form them by other means as, for example, roll forming out of a strip of suitable material.

Typically, the headers 10 will have their thin walled portion 32 on the exteriors thereof for ease of application and alignment of the strip 40 thereto. However, it is possible to provide the relatively thin area 32 on the interior of the header, that is, as part of the inner wall defining the passage 28.

Figure 5:
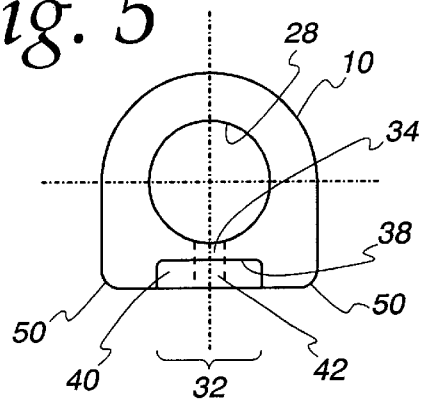
FIG. 5 is a cross-section of a modified embodiment of the header.

FIG. 5 shows an alternative embodiment where the header 10 is formed with a cross-section of a semi oval having sides terminating at points 50. In the embodiment of FIG. 5, the thin walled portion is located between the sides 50 and again is in the form of a relief provided by a groove 38 for receipt of a strip 40. The relative dimensions are the same as mentioned previously and therefore allow punching of the tube slots 34, 42 in both the header 10 and the strip 40. The header 10 and the strip 40 are, of course, metallurgically bonded to one another as mentioned previously.

Figure 6:
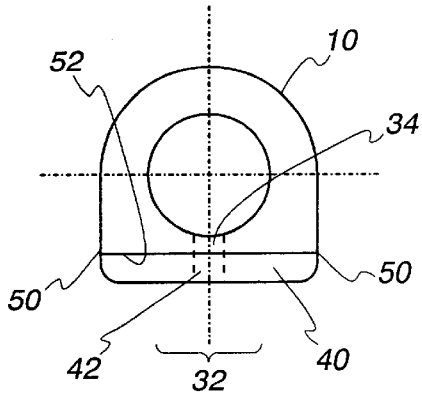
FIG. 6 is a cross-section of still another modified embodiment.

FIG. 6 illustrates still another embodiment of the header 10 and again one wherein its cross-section is that of a semi oval. In this case, the groove 38 is not formed in favor of a simple, planar surface 52 serving as a relief extending between the ends 50 of the semi oval. In this case, a somewhat wider strip 40 may be employed to extend from one side 50 to the other of the header semi oval shape.

Again, the arrangement is such that a thin walled portion 32 is provided to be covered by the strip 40.

In general, the embodiments shown in FIGS. 2 and 5 are preferred in that the groove 38 provides for ease of positioning of the strip 40. And of those two, the embodiment illustrated in FIG. 2 is preferred because, as a comparison of the cross-sections of each of the embodiments illustrated in FIGS. 2, 5 and 6 will show, less material is required to form the embodiment illustrated in FIG. 2 than either of the others, thereby assuring a minimum of cost.

It is also preferred that the tube slots 34 and 42 be elongated, thereby accommodating the use of flattened tubes such as the tube 16. It is also preferred that the direction of elongation of the tube slots 34 and 42 be in the direction of elongation of the headers 10 and 12 as this allows a reduction in the diameter of both the passage 28 and the header 10, 12. This reduction in diameter in turn allows the use of a thinner walled header 10, even at its relatively thick portion 30 while still meeting pressure resistance requirements for a system. It also minimizes the amount of material employed, all the while allowing the use of a fairly generous major dimension in the tubes 16.

By way of example, the embodiment illustrated in FIG. 2 may be made of a header having an outer diameter approximately 0.500 inches and with a diameter of the passage 28 of 0.25 inches. This provides a wall thickness of 0.125 inches for the relatively thick portion 30. The groove 38 may have a depth of about 0.062 inches while the strip 40 may have a thickness of 0.063 inches. The width of the strip 40 may also be approximately 0.250 inches.

In general, it is desirable that the thin walled portion 32, at its thinnest, be equal to approximately one-half the wall thickness of the header 10 and that the strip 40 have the same approximate thickness. When this is done, the ability to satisfactorily punch the tube slots 34 and 42 is maximized because both the thin walled portion 32 and the strip 40 will be at minimum thickness to facilitate punching.

Figure 7:
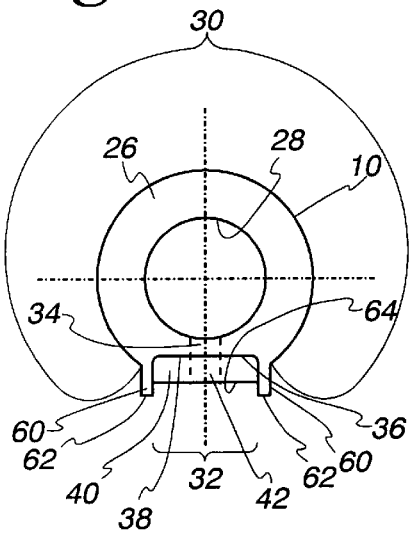
FIG. 7 is a cross-section of still another embodiment of the invention in a condition just prior to final assembly prior to brazing.
Figure 8:
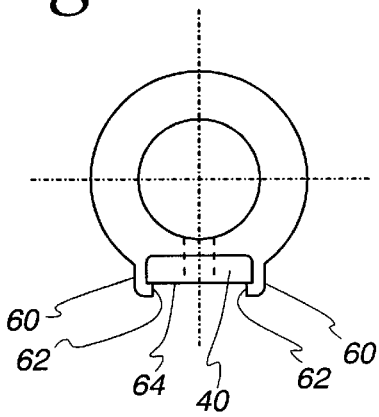
FIG. 8 is a cross-section of the embodiment of FIG. 7 at a subsequent step in its assembly and prior to brazing.

FIGS. 7 and 8 show still a further modification of the invention. It is illustated in the context of the embodiment illustrated in FIG. 2, but it will be readily appreciated that it is applicable to the embodiment of FIG. 5 as well. In the interest of brevity, the components common to the embodiment of FIG. 2 are given like reference numerals and will not be redescribed. In this embodiment, the groove 38 is flanked by tabs 60 along its length. As seen in FIG. 7, the ends 62 of the tabs extend beyond the radially outer side 64 of the strip 40 such that strip 40 nests within the groove 38 inwardly of the end 62 of the tabs 60. As seen in FIG. 8, the ends 62 of the tabs 60 may be crimped or otherwise deformed over the ends of the radially outer surface 64. This crimping may be along the entire length of the tabs 60 or may occur intermittently at desired locations along their length. In any event, the tabs 60, and specifically their ends 62 provide self-fixturing of the header tube assembly during brazing.

It is to be particularly noted that while the foregoing description is made with reference to the embodiment illustrated in FIG. 2, it is equally applicable to the embodiment illustrated in FIG. 5 and could actually even be employed with the embodiment of FIG. 6 if the width of the strip 40 were slightly reduced in the tabs placed on opposed sides of the surface 52. This structure assures that the strip 40 is firmly held within the notch 36 during brazing to assure a leak-free interface between the tube 10 and the strip 40.

From the foregoing, it will be appreciated that the invention provides a low cost, low mass header for volume production in systems such as $CO_2$ refrigeration systems having minimum burst pressures of about 6,500 psi or more. The invention allows the use of a one step punching operation for each of the headers and the strips and thus eliminates the currently required milling process for forming tube slots and headers of the thicknesses of concern.

We claim:

1. A header for a high pressure heat exchanger, comprising:

an elongated tubular like element having a central, generally cylindrical passage and a tube receiving side, said element being a unitary structure having a relatively thick wall partially surrounding said passage and a relatively thin wall at said tube receiving side;

a first mating surface defined by a relief at said relatively thin wall of said element;

a plurality of punched first tube receiving slots at said first mating surface in fluid communication with said passage and located at predetermined spaced intervals;

an elongated strip having a second mating surface complementary to and abutted against said first mating surface such that the thickness of said strip and said thin wall is substantially equal to or greater than the thickness of said thick wall; and wherein the first mating surface is further defined by the bottom of a groove formed on the exterior of said element and said strip is located in said groove;

a plurality of second, punched tube receiving slots in said strip and located therein at said predetermined intervals, said second tube receiving slots being generally of the same size and shape as said first tube receiving slots and aligned with said first tube receiving slots; and a joint bonding said element and said strip together.

2. The header of claim 1 wherein both said first and second mating surfaces are flat.

3. The header of claim 1 wherein said first mating surface is on the exterior of said element.

4. The header of claim 1 wherein said joint is a brazed joint.

5. The header of claim 1 wherein both said first and second mating surfaces are flat, said joint is a brazed joint and said first mating surface is on the exterior of said element.

6. The header of claim 5 wherein said element is a semi oval in cross section and said first mating surface extends between the sides of said semi oval.

7. The header of claim 6 wherein said first mating surface is defined by the bottom of a groove formed in said exterior and said strip is located in said groove.

8. The header of claim 6 wherein said tube slots are elongated in the direction of elongation of said element.

9. The header of claim 1 including tabs on opposite sides of said relief and deformed over opposite sides of said elongated strip.

10. A high pressure heat exchanger comprising:

at least one header defined by an elongated tubular like element having a central, generally cylindrical passage and a tube receiving side, said element being a unitary structure having a relatively thick wall partially surrounding said passage and a relatively thin wall at said tube receiving side;

a first mating surface defined by a relief at said relatively thin wall of said element;

a plurality of punched first tube receiving slots at said first mating surface in fluid communication with said passage and located at predetermined spaced intervals;

an elongated strip having a second mating surface complementary to and abutted against said first mating surface such that the thickness of said strip and said thin wall is substantially equal to or greater than the thickness of said thick wall;

a plurality of second, punched tube receiving slots in said strip and located therein at said predetermined intervals, said second tube receiving slots being generally of the same size and shape as said first tube receiving slots and aligned with said first tube receiving slots;

a joint bonding said element and said strip together;

said tube slots being elongated in the direction of elongation of said element;

a plurality of tubes, each of flattened cross section, having their ends disposed within corresponding ones of said tube slots, said tube ends being twisted about 90° to the remainder of the corresponding tube; and fins extending between and bonded to adjacent ones of said tube remainders.

11. The heat exchanger of claim 10 wherein said fins are serpentine fins.

12. The header of claim 10 wherein both said first and second mating surfaces are flat.

13. The header of claim 10 wherein said first mating surface is on the exterior of said element.

14. The header of claim 10 wherein said joint is a brazed joint.

15. The header of claim 10 wherein both said first and second mating surfaces are flat, said joint is a brazed joint and said first mating surface is on the exterior of said element.

16. The header of claim 15 wherein said first mating surface is defined by the bottom of a groove formed in said exterior and said strip is located in said groove.

17. The header of claim 15 wherein said element is a semi oval in cross section and said first mating surface extends between the sides of said semi oval.

18. The header of claim 17 wherein said first mating surface is defined by the bottom of a groove formed in said exterior and said strip is located in said groove.

19. The header of claim 16 wherein said tube slots are elongated in the direction of elongation of said element.

20. The header of claim 10 including tabs on opposite sides of said relief and deformed over opposite sides of said elongated strip.

* * * * *